US009492850B2

(12) United States Patent
Krouglicof et al.

(10) Patent No.: US 9,492,850 B2
(45) Date of Patent: Nov. 15, 2016

(54) METHOD AND APPARATUS FOR REMOVING LABELS FROM WINE AND BEVERAGE BOTTLES

(71) Applicant: EVER GREEN ENVIRONMENTAL CORPORATION, St. Johns (CA)

(72) Inventors: Nicholas Krouglicof, Mount Carmel (CA); Andrew Fisher, St. John's (CA); Gerard Tracey, St. John's (CA); Christopher Hynes, St. John's (CA)

(73) Assignee: EVER GREEN ENVIRONMENTAL CORPORATION, St. John's (CA)

( * ) Notice: Subject to any disclaimer, the term of this patent is extended or adjusted under 35 U.S.C. 154(b) by 725 days.

(21) Appl. No.: 13/690,384

(22) Filed: Nov. 30, 2012

(65) Prior Publication Data

US 2013/0087170 A1 Apr. 11, 2013

Related U.S. Application Data

(63) Continuation-in-part of application No. PCT/CA2011/050331, filed on Jun. 1, 2011.

(60) Provisional application No. 61/350,166, filed on Jun. 1, 2010.

(51) Int. Cl.

| | |
|---|---|
| ***B08B 3/00*** | (2006.01) |
| ***B08B 1/00*** | (2006.01) |
| ***B08B 1/04*** | (2006.01) |
| ***B08B 9/08*** | (2006.01) |
| ***B08B 9/36*** | (2006.01) |
| ***B08B 9/42*** | (2006.01) |

(52) U.S. Cl.

CPC ..... *B08B 1/002* (2013.01); *B08B 1/04* (2013.01); *B08B 9/083* (2013.01); *B08B 9/36* (2013.01); *B08B 9/42* (2013.01)

(58) Field of Classification Search

None

See application file for complete search history.

(56) References Cited

U.S. PATENT DOCUMENTS

| | | | |
|---|---|---|---|
| 3,946,750 | A | 3/1976 | Fischer et al. |
| 5,679,210 | A | 10/1997 | Thomas |
| 6,514,353 | B1 | 2/2003 | Green et al. |
| 2009/0255603 | A1 | 10/2009 | Schiller et al. |

FOREIGN PATENT DOCUMENTS

| | | |
|---|---|---|
| EP | 0267619 | 5/1988 |
| JP | 5004079 | 1/1991 |
| JP | 7080428 | 3/1995 |

OTHER PUBLICATIONS

International Search Report in PCT/CA2011/050331, mailed Aug. 22, 2011.

*Primary Examiner* — Eric Golightly

(74) *Attorney, Agent, or Firm* — Kutak Rock LLP; Bryan P. Stanley

(57) ABSTRACT

There is provided a system for removing a glued-on label from a wine bottle or other container, comprising in spatial sequence a brushing station for dry-brushing the container surface, a solvent station for applying a liquid solvent for removal of adhesive from the container surface, a container support, a drive for imparting relative motion between the brush and a containers when aligned with the brushing station, and a indexing system for imparting relative motion between the container support and stations whereby each of said containers on said support is brought into alignment and contact with the respective stations for sequential mechanical and solvent-based label removing steps.

26 Claims, 12 Drawing Sheets

METHOD AND APPARATUS FOR REMOVING LABELS FROM WINE AND BEVERAGE BOTTLES

CROSS REFERENCE TO RELATED APPLICATIONS

This application is a continuation in part of Patent Cooperation Treaty Application no. PCT/CA2011/050331, filed on Jun. 1, 2011, which claims priority from U.S. Patent Application No. 61/350,166 filed on Jun. 1, 2010. The contents of said applications are incorporated herein by reference.

TECHNICAL FIELD

The present disclosure relates to recycling technologies and in particular to a method and apparatus for removing glued-on labels from wine and beverage bottles and other containers for re-use.

BACKGROUND

Used wine bottles are frequently collected for recycling. However, removal of the glued-on labels is typically a labour intensive manual process that makes it difficult to re-use such bottles. It is generally not considered cost-effective to prepare such bottles for re-use by removing the labels. Instead, used containers are usually recycled by crushing, thereby resulting in a loss of economic value as well as increased energy consumption and environmental harm caused by the processes and steps involved in re-forming the crushed glass into new bottles.

Although automated systems for removing bottle labels have been proposed, the cost and difficulty of label removal from wine bottles is exacerbated by the wide variety of bottle shapes, as well as the wide variety in type, number, positioning and composition of the labels and the multiple types of adhesive used. Various mechanical or solution-based systems and devices have been proposed for this purpose, such as those disclosed in U.S. Pat. Nos. 5,679,210 and 3,946,750, and published U.S. patent application no. 2009/0255603A1.

Many vineyards, wine producers and other beverage bottling operations, in particular small-scale operations, would benefit from a relatively simple and compact device or system for removing labels from used wine bottles and other containers, in order to permit their re-use.

SUMMARY OF THE INVENTION

According to one aspect, the present invention is based on the discovery that glued-on labels on glass bottles can be efficiently removed by dry brushing, preferably with a wire brush that can remove the label without scoring the container. The remaining adhesive residue can then be removed in a subsequent solvent-applying step. The invention is directed primarily to glass containers, but may be adapted for use with other containers.

According to another aspect, the invention relates to a system for removing a glued-on label from exterior surface of a glass bottle or other container, comprising multiple stations and an indexing system for conveying used bottles between the stations in a step-wise manner between stations for sequentially performing a sequence of label-removing and cleaning steps.

According to a further aspect, the system comprises: a brushing station for removal of a substantial portion of the label by brushing (including by dry-brushing), the brushing station comprising at least one brush which may consist of a rotationally-driven cylindrical brush, such as a metal wire brush; a solvent station for applying a liquid solvent for removal of adhesive from the container, which may also comprise a brush as described above; optionally, a rinsing station for rinsing the solvent from the bottle; a container support for retaining a container; a drive for imparting relative motion between the brushes and a container when aligned with the brushing station, such as a rotary drive for the brushes and a further rotary drive for rotating the container; and an indexing system for providing relative motion between the support and said stations whereby the container is sequentially brought into alignment and contact with the brushing station and solvent station for sequential mechanical and solvent-based label removing stages. The indexing system may comprise a conveyor for conveying containers while the stations remain stationary, such as a carousel-type conveyor which conveys the bottles in a circular pattern around a series of stations arranged in a ring. The indexing system may comprise a first drive for conveying containers between the stations in a first direction of motion, and a second drive for urging the containers into the stations in a second direction of motion. In the embodiment wherein the indexing system comprises a rotating carousel comprising a plurality of bottle supports, the second drive may move the bottle supports in a radial direction to urge the containers towards the respective stations, when aligned therewith.

The terms "indexing" and "indexed" as used herein refer to a mode of operation wherein the conveyor is only in motion when the bottles are being delivered from one station to the next, and ceases movement while bottles are within respective stations for treatment. An "indexed" system is one wherein conveyor movement is step-wise and occurs in discrete increments only when shifting the bottles between stations. The spacing between stations is arranged wherein one step-wise movement of the conveyor shifts all of the bottles engaged in the system simultaneously from one station to the next, where they dwell for a predetermined and equal period of time.

In another aspect of the system, the container support permits reciprocal vertical movement of a container mounted thereon, such as a spring-loaded telescoping shaft. At least one station further comprises a reciprocating drive member for contacting said container and imparting a vertical reciprocating movement thereto when aligned with said station.

In another aspect, the indexing system comprises a rotatably driven turntable with an array of radially-extending rails or other elongate supports thereon. The container supports consist of carriages slideably secured to said supports wherein radial travel of said carriages brings said carriage into contact with one of said stations when aligned therewith. Drives are provided to both rotate the turntable in incremental fashion between the stations and to advance the carriages along the rails. Further drives may be provided with each carriage to rotate the bottles mounted thereon, for contact with the brushes and other station treatments while rotating the bottles.

In another aspect, the system includes a controller configured to incrementally advance the turntable to sequentially align the container supports with said stations, and to advance and retract the container supports radially at said stations for treatment at respective ones of said stations for a predetermined duration.

In another aspect, the bottles are pre-soaked and the initial brushing step that is performed on pre-soaked bottles. The bottles can also be subject to an internal rinse and cleansing step within a station of the system.

According to another aspect, the invention relates to a method for removing a label secured to an exterior surface of a container by adhesive, comprising the steps of loading a container onto an indexing system, which may comprise the elements described above; conveying the container in an indexed manner to a sequence of stations for sequential application of label-removing steps, comprising contacting the container with a brush and brushing at least a substantive portion of the label from the container, and applying a solvent to the exterior surface of the container and optionally the interior surface of the container for removing said adhesive and optionally other debris from the container; and optionally rinsing the container in a rinsing station. The brushing step may be performed with the bottles dry or pre-soaked.

According to another aspect of the invention, the method comprises subjecting the bottles to a preliminary soaking step to soften the label prior to the initial brushing step.

Directional and geometric references herein are generally used for convenience of description and are not intended to limit the invention, unless otherwise specified. For example, terms such as "vertical", "circular" and the like include departures from the strict meanings of such terms unless otherwise specified.

BRIEF DESCRIPTION OF THE DRAWINGS

Like reference numerals are used in the drawings to denote like elements and features.

DESCRIPTION

Figure 1:
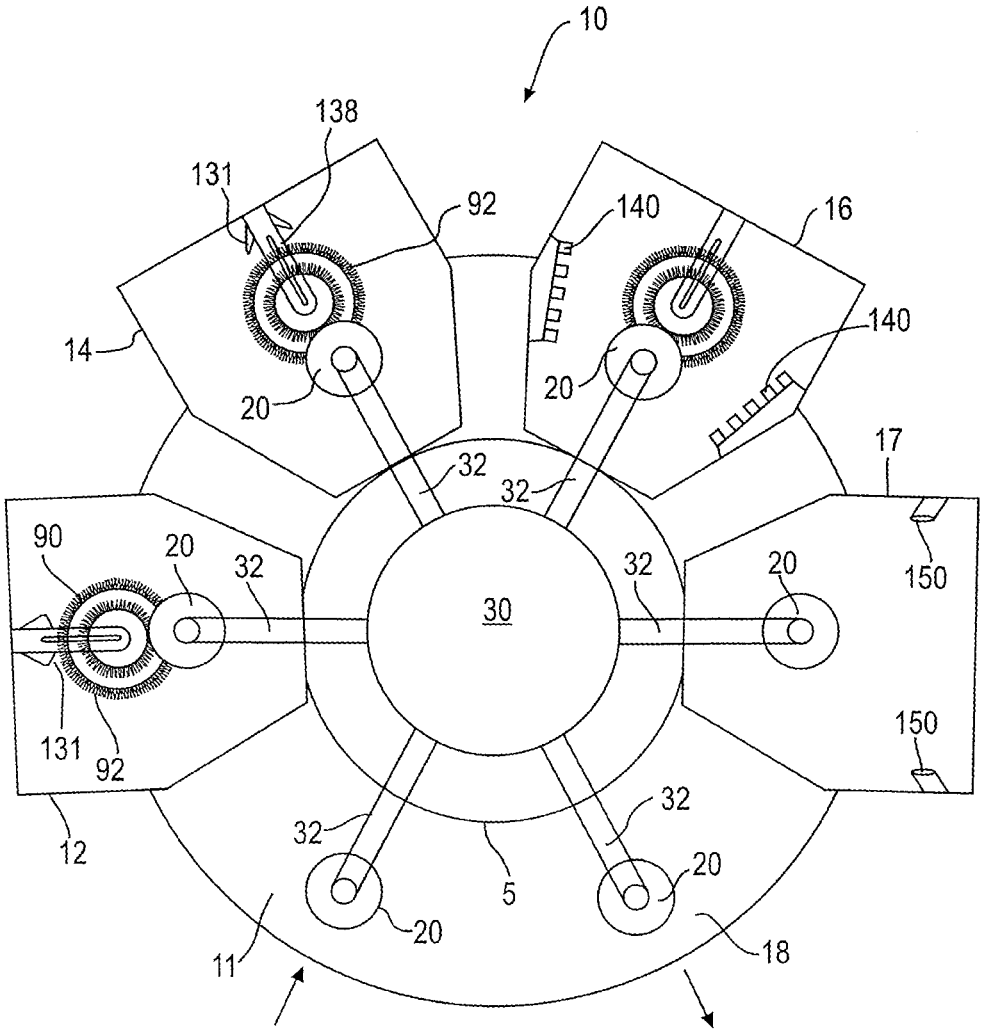
FIG. 1 is a schematic view of a system according to a first embodiment of the present invention.

FIGS. 1-7 illustrate a first embodiment of a label-removing assembly 10 for removing labels secured to an exterior surface of a wine bottle or other container by adhesive. The typical container that may be processed is a conventional glass wine bottle 1 comprising a body 2 and neck 3. As well, the present system may readily be adapted for other types of containers and different configurations and container compositions. System 10 comprises an indexing system for conveying bottles 1 in an indexed fashion, consisting of a rotary conveyor 5 which cycles bottles 1 in a circle through a sequence of cleaning stations, arranged in a ring around conveyor 5. The stations include a bottle loading station 11, a mechanical brushing station 12, a solvent application station 14, a rinsing station 16, a drying station 17 and a bottle unloading station 18. It will be seen that additional stations may be included, such as multiple stations for performing the steps described herein, or additional steps such as additional bottle cleaning steps or applying new labels. As well, the rinsing station may not be necessary depending on the solvent selected.

Circular conveyor 5 comprises a turntable assembly 6, which is supported on a base 22. Base 22 comprises legs 24, horizontal supports 26 and optionally other frame elements. Legs 24 may be bolted to the workshop floor for stability. Turntable assembly 6 comprises a central solid platform 30 that is rotatably mounted to base 22, as described below. An array of six equi-spaced horizontally-disposed arms 32 project radially outwardly from platform 30 in a spoke-like fashion and connect platform 30 with a hexagonal rim 34. Arms 32 project radially outwardly past rim 34 to support a plurality of bottle holder assemblies 20 at the distal end of each arm. Rotation of turntable 6 cycles bottle holders 20 between stations 11, 12, 14, 16, 17 and 18, which are arranged in a ring around the perimeter of conveyor 5.

System 10 is described herein as comprising six container supports, which permits simultaneous processing of up to 6 bottles and results in a hexagonal configuration of conveyor 5. This configuration also permits the indexing of holders 20 with up to six stations. However, it will be seen that other configurations of the system permit a greater or less number of stations and container supports, for example a 4, 5, 7, 8 or other number of container supports and stations, with consequential alterations of the system configuration.

Figure 2:
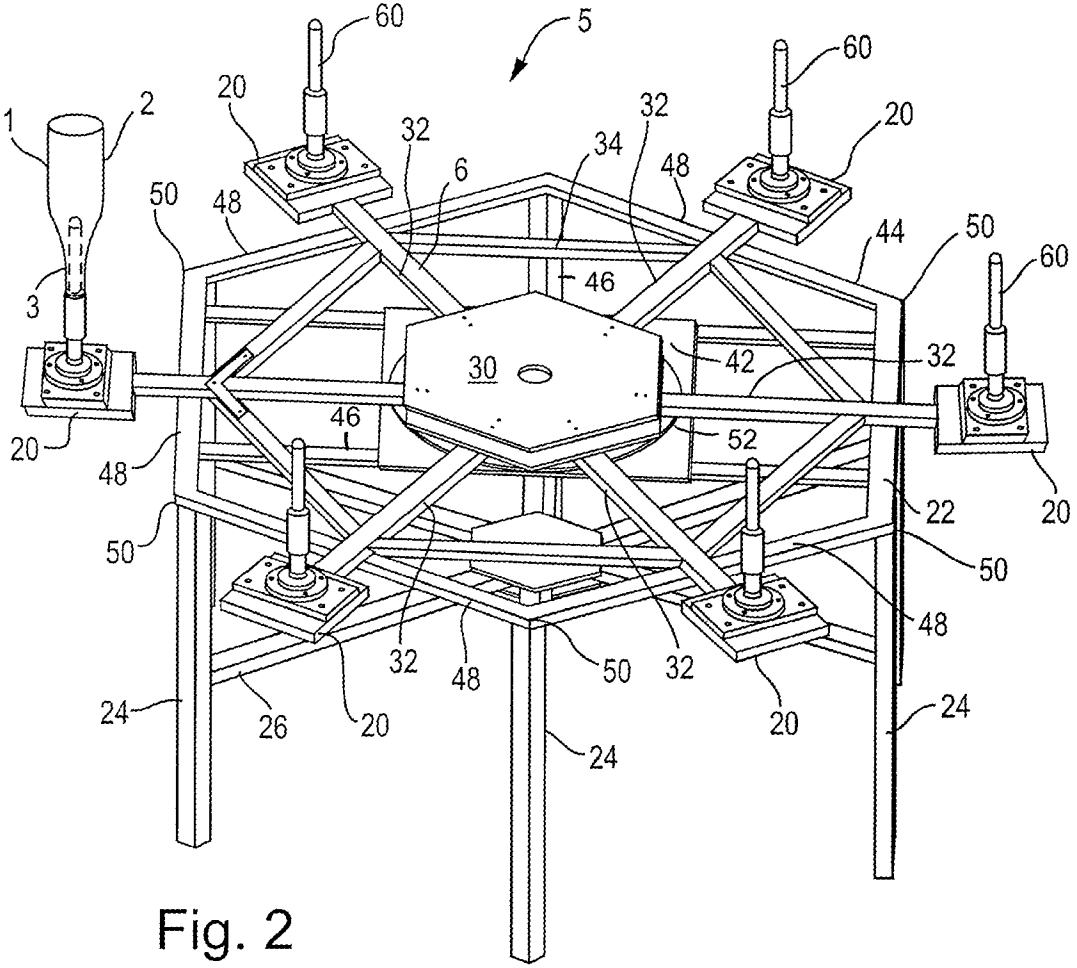
FIG. 2 is a front perspective view of the central carousel portion of said system.

Base 22 comprises a central upper plate 42 and an outer rim 44. An array of horizontal arms 46 connect plate 42 with rim 44. Rim 44 is hexagonal, with a diameter greater than rotatable rim 34. Rim 44 consists of six straight segments 48, meeting at vertices 50. As seen in FIG. 2, the respective rims 34 and 44 and arms 32 are configured such that container supports 20 project radially outwardly past the midpoints of segments 48. In this fashion, bottle holders 20 can project radially outwardly from conveyor 5 to be introduced into the various stations located outside the periphery of conveyor 5, as discussed below.

Figure 7:
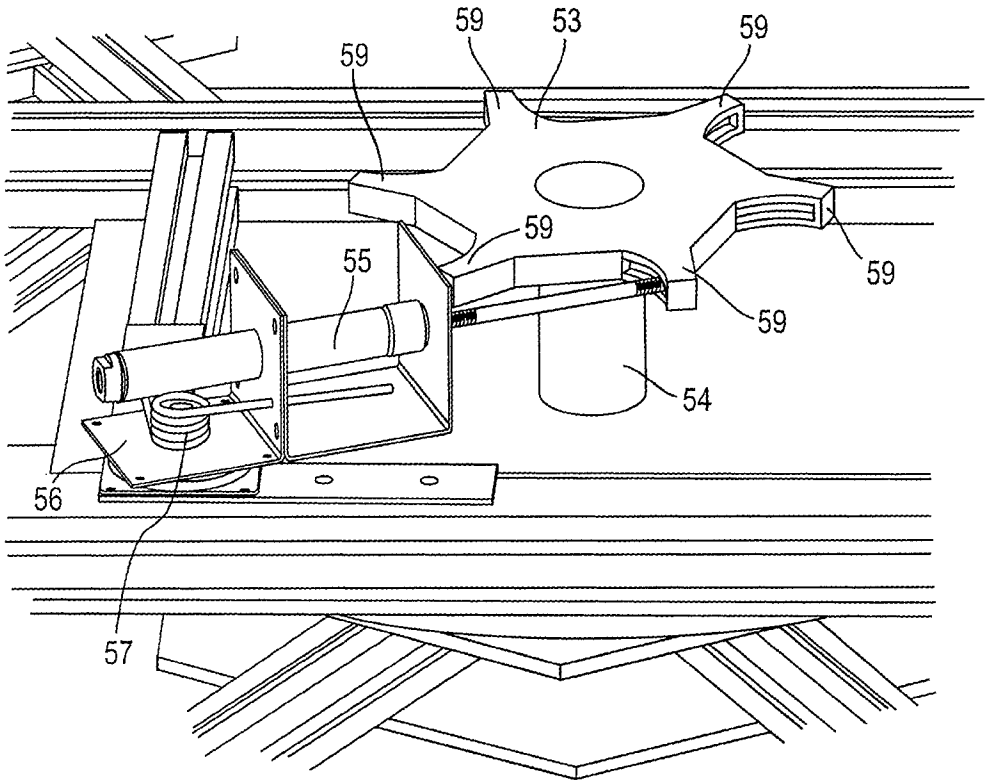
FIG. 7 is perspective view of the rotary drive for the carousel portion of the system.

Platform 30 is supported on a turntable 52, which in turn is supported on and mounted to a star-shaped spinner disk 53, seen in FIG. 7. Disk 53 is rotatably mounted to base 22 by a central vertical spinner shaft 54. Shaft 54 is rotatably journalled to plate 42, which for clarity is not shown in FIG. 7. Platform 30 is rotated in step-wise discrete increments corresponding to the stations, whereby each increment aligns container supports 20 with the stations in step-wise indexed fashion wherein rotation proceeds by equal increments in an indexed fashion wherein each increment advances the platform by the angular amount required to align with the respective stations. Spinner disk 53 is rotatably driven by a pneumatic ram 55, mounted to base 22 by a mount 56 which pivots on a horizontal plane about a vertical axis. A torsion spring 57 urges mount 56 horizontally inwardly towards the axis of turntable 52. Spinner disk 53 comprises an array of arms 59, which are configured to provide a contact surface for the plunger of ram 55. Disk 53 comprises six arms 59, spaced equally around the disk. In operation, platform 30 is rotated by actuating ram 55, whereby the plunger extends to contact one of arms 59 to rotate spinner disk 53. Ram 55 is controlled whereby disk 53 is rotated by one increment comprising one sixth of a complete circle, thereby indexing the six bottle holders 20 of turntable assembly 6 between the six stations. Arms 59 each comprise a curved, recessed surface which serves as a sliding contact surface for the plunger of ram 55. As disk 53 rotates, it causes ram 55 to pivot horizontally outwardly. After disk 53 is rotated to advance platforms 30 by one increment, ram 55 retracts. Spring 57 pivots ram 55 inwardly, in position to contact the next in line of arms 59 to repeat the process wherein platform 30 is rotated by sequential increments corresponding to the spacing of the stations so as to sequentially align bottle holders 20 with the respective stations.

Figure 3:
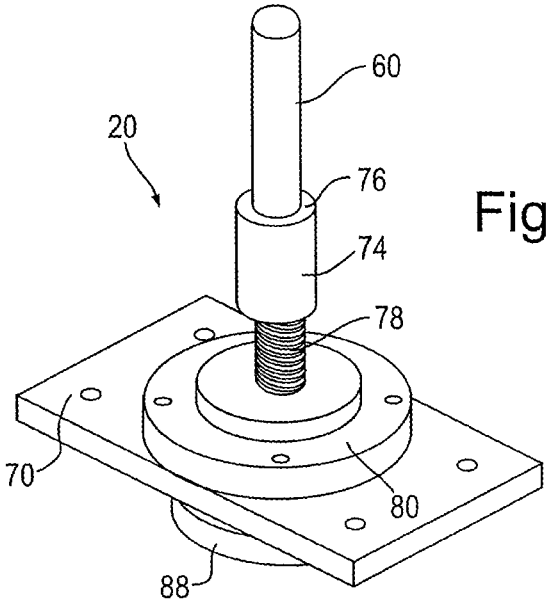
FIG. 3 is a front perspective view of the bottle-carrying spindle portion of the system.
Figure 4:
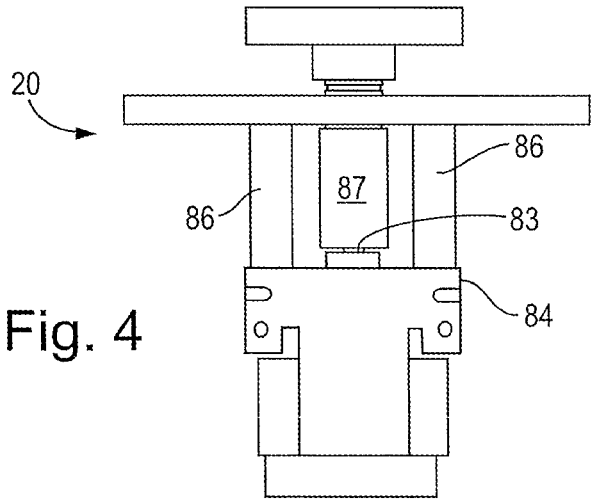
FIG. 4 is a front elevational view of the drive for the bottle-carrying portion of the system.
Figure 6:
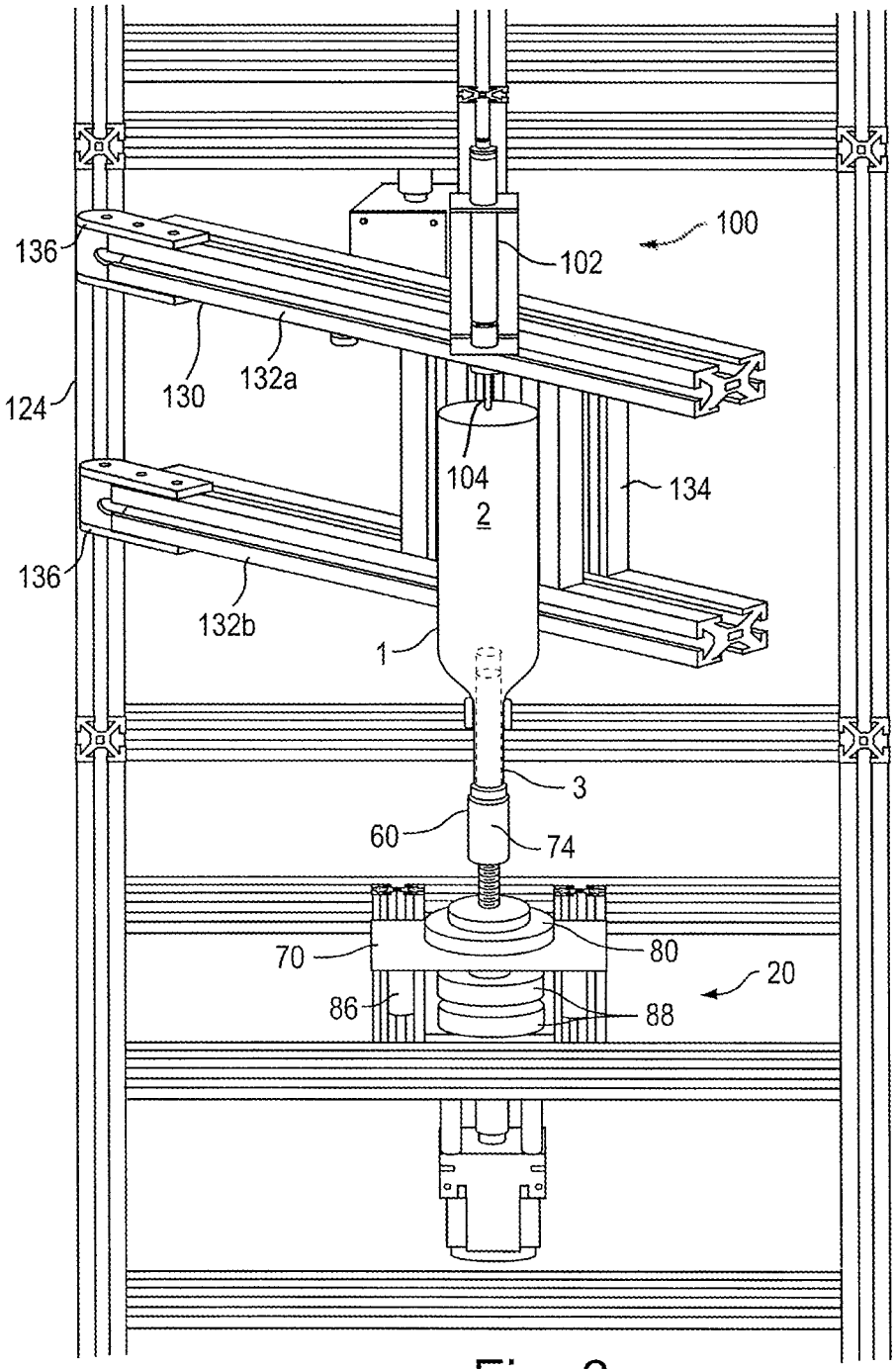
FIG. 6 is a front view of a station of the system.

Bottle holder assemblies 20, seen in detail in FIGS. 3, 4 and 6, are equally spaced apart on upper frame 6, and are spaced to correspond to the vertices of a hexagon, such that multiple assemblies 20 can be aligned with each station simultaneously for processing. Each assembly 20 comprises a horizontal base plate 70 which mounts to a distal end of a corresponding arm 32 to project radially outwardly from platform 30. The upper face of plate 70 supports a bearing mount disk 80, which rotatably journals a bottle mounting post 60. Post 60 protrudes upwardly, and is configured to be inserted into the bottle neck 3, to snugly hold the bottle in an inverted position. Post 60 includes a collar 74 intermediate its upper and lower ends, the upper surface of which forms a flat shoulder 76 upon which the lip of bottle 1 rests when inverted. A coiled compression spring 78 encircles the lower portion of post 60 and abuts the lower face of collar 74 to restrict downward movement of shaft so as to spring-load post 60 for reciprocating vertical movement. Post 60 extends through bearing mount disk 80, the upper surface of which provides a contact surface for compression spring 78. Post 60 is rotatably driven by electric motor 84. The lower end of post 60 extends through an aperture (not shown) within plate 70 into a clutch disk couplers 88 located on the underside of plate 70. Coupler 87 couples post 60 with the output shaft 83 of motor 84. Coupler 87 permits vertical movement of post 60 while transmitting rotational movement, thereby permitting reciprocating vertical movement of post 60. One or more clutch disks 88 may be provided (see FIG. 6) to couple motor output shaft 83 with bottle support post 60. Motor 84 can be variable speed, and can be operatively connected to a central controller 200 to control the operation thereof. Motor 84 is mounted to the underside of plate 70 by motor mounts 86, seen in FIG. 6.

Figure 5:
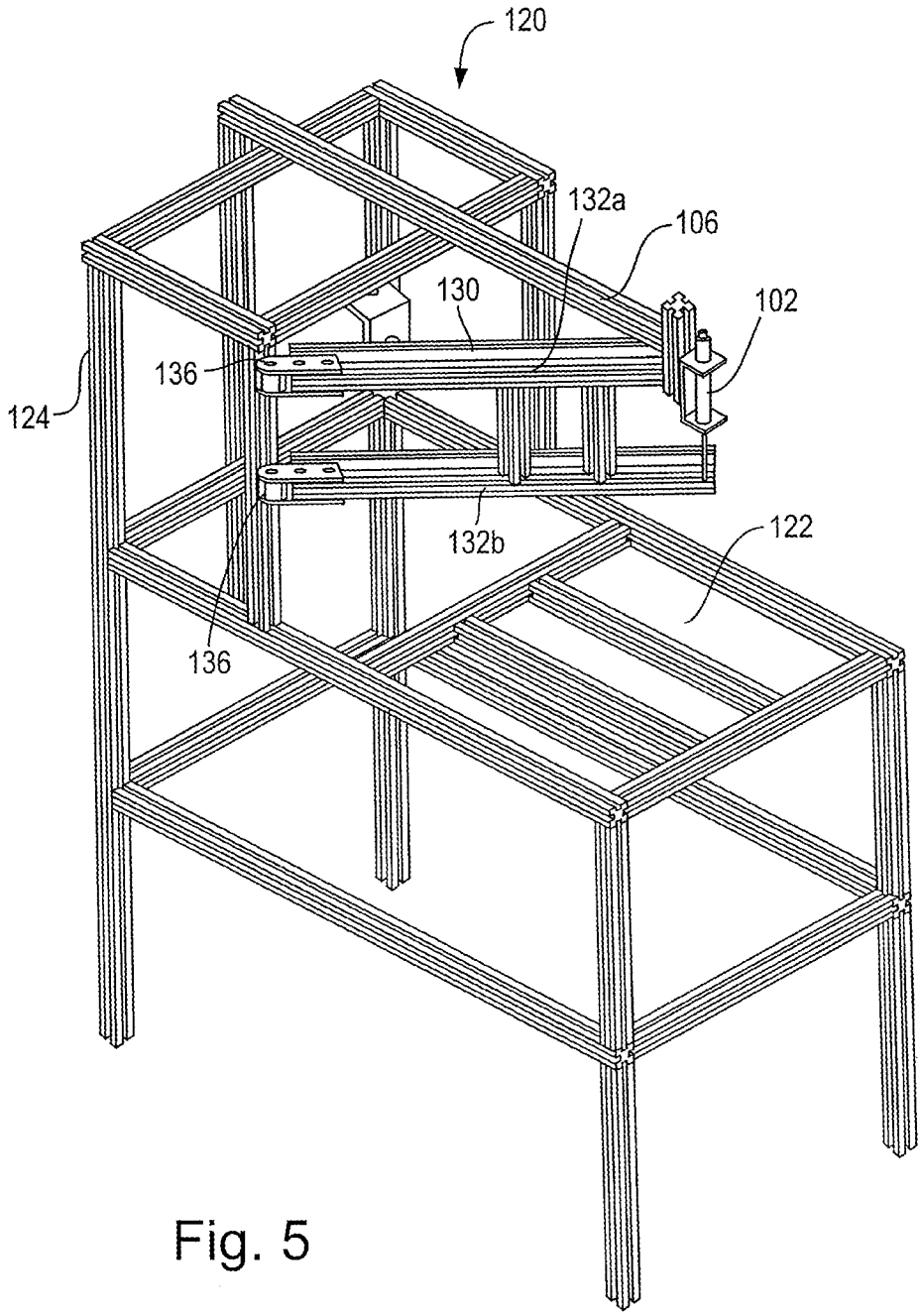
FIG. 5 is a front perspective view of the supporting frame of an individual station of the system.

Turning to the processing stations 11-18, these are each independently supported on a frame 120 that has a generally chair-like configuration, consisting of a table 122 and an upright portion 124 projecting upwardly at an end thereof, as shown in FIG. 5. Frames 120 may be connected to lower frame 22 by connection members (not shown), or alternatively may be separately fastened to the floor for a more permanent installation of the system. Frames 120 are configured such that bottle holders 20 can project over table 122 when aligned with the respective station, with the processing mechanism associated with the station being located on upright portion 124 for processing the bottle.

At certain of the stations, a clamping/reciprocating mechanism 100 is provided to urge the bottle downwardly so as to clamp the container onto post 72 to prevent unwanted movement or release. Mechanism 100 is also configured to reciprocate bottle 1 vertically so as to improve the contact between the surface of the bottle and brushes 90. As seen in FIG. 6, mechanism 100 comprises a vertical plunger 102, mounted to frame 120 for vertical movement. Plunger 102 is configured such that its lower bearing surface 104 may contact the base of bottle 1. Surface 104 may be rotatable to permit rotation of bottle 1 while in contact therewith. Plunger 102 may be driven by a pneumatic ram or other linear actuator. In operation, plunger 102 is normally in an elevated position during transition periods when no container support 20 is located within a corresponding station. When a bottle holder 20 is rotated into position for processing within a station, plunger 102 is actuated to travel downwardly, whereby bearing surface 104 is brought to bear downwardly on the base of wine bottle 1. Plunger 102 is controlled whereby bottle 1 is urged downwardly by a selected amount, thereby compressing spring 78, and urging the lip of bottle 1 against shoulder 76 of collar 74 with sufficient force to prevent or minimize unwanted slippage of bottle 1, during rotation thereof. For this purpose, shoulder 76 may comprise a non-slip material such as rubber. Following processing within the corresponding station, plunger 102 is elevated, thereby releasing bottle 1, such that it may be carried to the next processing station. It will be seen that the amount of downward travel of plunger 102 may be varied, and is pre-set for a selected bottle size.

In addition to the downward force for clamping the bottle, plunger 102 can also be reciprocated for moving bottle 1 in a reciprocating vertical movement, whereby downward movement is applied by plunger 102 and upward movement is driven by compression spring 78.

Operation of the ram or other actuator is controlled by central controller 400, described below.

As seen in FIG. 5, plunger 102 is mounted on a rigid overhead arm 106, which projects laterally from upright portion 124 of frame 120. Plunger 102 is positioned in a substantially overhead position.

Frame 120 comprises a swing-arm support 130 for mounting a brush assembly and/or a liquid dispensing assembly or other bottle processing component. Support 130 comprises a pair of spaced apart horizontal arms 132, consisting of upper arm **132*a* and lower arm 132*b*. Arms 132 are connected together by vertical members 134. The proximal ends of arms 132 are pivotally mounted to frame portion 124 by hinge mounts 136. Pivotal movement of support 130 is actuated by a horizontal linear actuator (which may comprise a hydraulic or pneumatic cylinder), whereby expansion of the actuator pivots mounts 130 outwardly, and contraction thereof withdraws mount 130 towards frame portion 124**.

It will be seen that although in the described embodiment the stations remain stationary while the bottle-holding system cycles the bottles, the system may also be configured such the bottle holding system remains stationary while the processing stations are transited.

The first in line station comprises a bottle loading station, wherein used bottles are loaded one at a time onto exposed posts 60 as these are presented in the station.

Next in line is brushing station 12, shown schematically in FIG. 1, which comprises a brush assembly 92. Assembly 92 includes one or more cylindrical wire brushes 90. It has been found that rotary application of a wire brush against a bottle can effectively remove glued-on labels adhered to the outside surface of the bottle, leaving only a glue/adhesive residue remaining on the bottle. At this stage, the brushing is conducted in a dry environment without the application of any solvent. Brush 90 is mounted to support 130 in a vertical orientation for contacting the exterior surface of bottle 1, whereby pivoting support 130 outwardly causes brush 90 to contact and bear against bottle 1. Brush 90 is rotatably driven by a motor mounted to support 130. Optionally, brush 90 may also travel vertically in reciprocating fashion. During the dry brushing stage, bottle 1 is rotated about its vertical axis by rotation of post 60 for full contact of its exterior surface with brush 90.

In operation, a bottle holder 20, bearing bottle 1 in inverted position, is rotated into alignment with station 12, following which support 130 is pivoted outwardly to contact 1. At this location, bottle 1 is aligned vertically with plunger 102, which is actuated to travel downwardly to clamp bottle 1 onto post 70 to limit lateral movement. Bottle 1 is then rotated by actuating motor 84, while also rotating brush 90 in a counter-direction, thereby brushing the exterior of bottle 1 in a dry brushing process. The duration of the brushing stage and the pressure applied by brush 90 can be determined based on trial runs to determine the optimum conditions for the bottles being processed.

Brushing station 12 further comprises a vacuum nozzle 131, connected to a vacuum source and filter (not shown) adjacent to brush 90 for debris removal.

The next-in-line station comprises solvent station 14. Station 14 comprises a brush assembly 92 to provide additional mechanical scrubbing of the bottles. Station 14 further comprises at least one nozzle 138 for directing a solvent solution to brush 92 for contacting the exterior surface of the container. Nozzle 138 is connected to a pressurized source of adhesive-removal solvent, not shown. Nozzle 138 can be mounted on support 130 so as to dispense the solvent onto the brush 90 as this contacts bottle 1. Station 14 further comprises a vacuum nozzle 131.

The nature of the solvent will depend on the adhesive as well as additional considerations including economic and environmental. The solvent should be polar and/or water soluble, such that it can be fully cleansed by a water rinse. For removal of non water-soluble adhesives, a suitable solvent is "Goo Goner™". In some cases, the label adhesive is water soluble, such that it can be removed purely with water or an aqueous solvent. Such solvents may also be used for the initial pre-soak stage described below.

Nozzle 138 is mounted to support 130, and may move upwardly or downwardly to dissolve adhesive affixing labels at different positions along the container. Alternatively, one or more nozzles 138 are mounted to frame 120.

Solvent station 14 comprises a catch basin to catch the used solvent. A conduit connects the basin to the solvent source for re-use, with a pump for pumping the solving into the source and pressurizing the solvent. A filter removes any solid debris from the solvent.

Operation of station 14 is similar to station 11, wherein a bottle 1 is introduced into station 14 and retained in position with plunger 102 whereby brush assembly 92 is brought into contact with bottle 1 The brushes and bottle are both rotated counter to each other, while solvent is dispensed onto the bottle via nozzle 138. Following this step, bottle 1 is cycled away from station 14, and into rinse station 16.

Rinse station 16 is similar in configuration to solvent station 14. One or more nozzle arrays 140 are mounted to frame 120 for directing streams of rinse water on bottle 1 when positioned in station 16. Station 16 includes a pressurized water tank connected to nozzle arrays 140, and a catch basin and filter similar to station 14. The rinse solution can be heated. Rinse solution is also sprayed into the interior of the container. For this purpose, an internal rinse nozzle (not shown) maybe provided in rinse station 16. The interior rinsing step is simultaneous with the exterior rinsing of the container. Rinse station 16 further comprises a brush assembly similar to assembly 92 to provide additional mechanical scrubbing of bottle 1.

Next-in-line from rinse station 16 is drying station 17. Station 17 may comprise heated air jets 150 for rapid drying of bottles 1.

The last in line station comprises unloading station 18, where the processed bottles are removed. The loading and unloading stations 11 and 18 may be combined into a single station. These stations may comprise merely an open space for an operator to manually load and unload bottles from the assembly.

FIGS. 8 through 14 illustrate a second embodiment of assembly 10.

Figure 8:
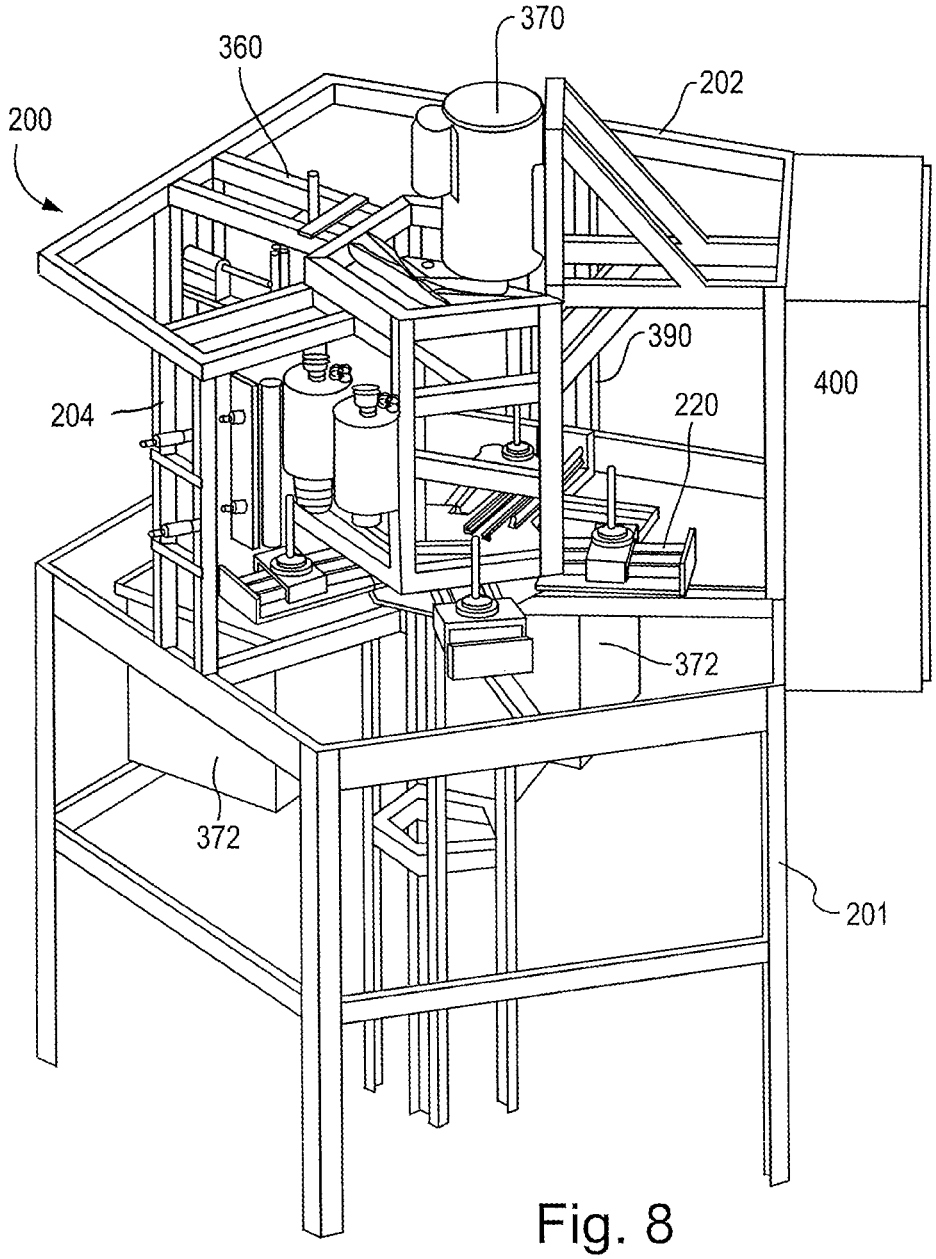
FIG. 8 is a perspective view of a second embodiment of the invention.
Figure 9:
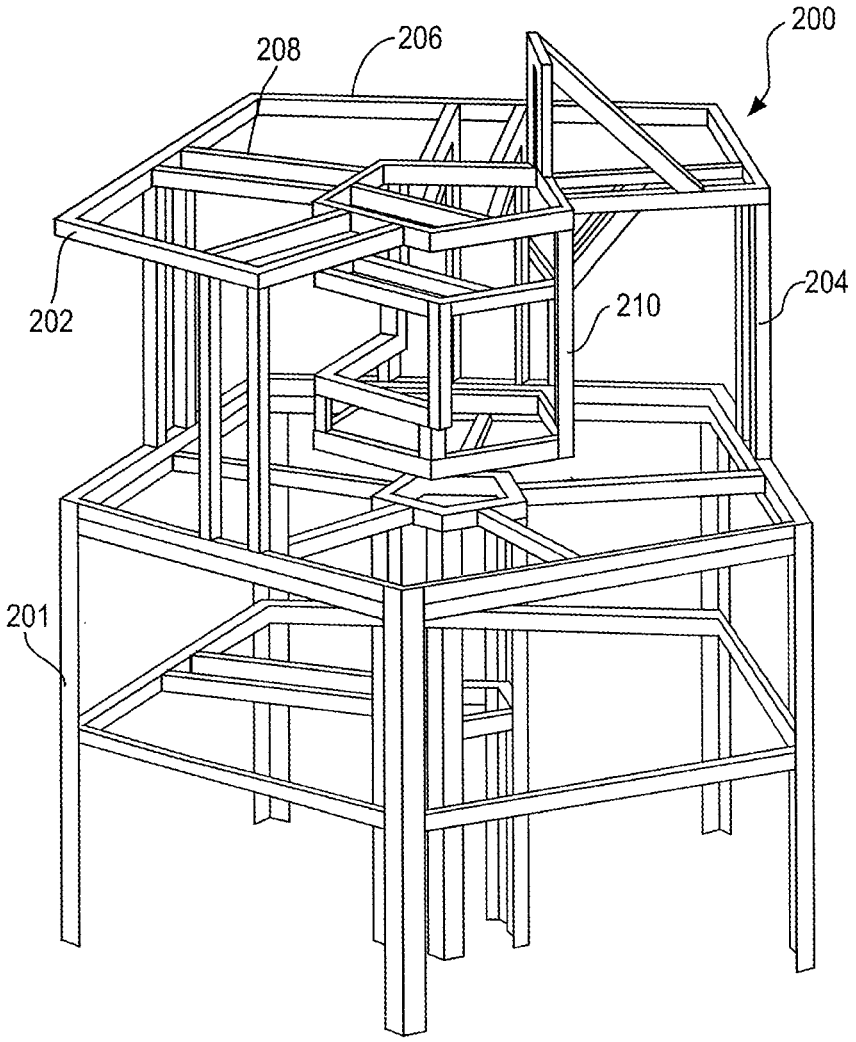
FIG. 9 is a perspective view of the frame portion of the second embodiment.

As seen in FIGS. 8 and 9, assembly 10 of the second embodiment comprises a multi-sided frame 200. As shown, frame 200 has five sides, corresponding to five bottle-processing stations. The stations, described in more detail below, consist in sequence of a bottle loading station, a dry brushing station for purely mechanical label removal, a solvent-application station, a rinsing station, and a bottle unloading station. As with the above embodiment, the configuration of the system, and the corresponding number of stations, may vary to increase or decrease the number of stations. Frame 200 comprises an open framework of stainless steel beams or other structural members arranged in a lower frame 201 and upper frame 202. Lower frame 201 is five-sided, and supports a turntable assembly 220, described below. Upper frame 202 is supported on lower frame 201 and comprises legs 204 which support an upper rim 206. Horizontal arms 208 protrude radially inwardly from rim 206. Arms 208 support a centrally-located suspended frame 210, which is suspended from arms 208 so as to depend downwardly therefrom, leaving a gap with lower frame 201. Frame 210 is five-sided, so as to correspond with the configuration of lower frame 201. Suspended frame 210 is configured to support a plurality of bottle processing stations centrally within label removal system 200. Station 210 comprises one or more open "window" areas, comprising sections of the frame unobstructed by structural members to thereby permit expose components such as the wire brush assemblies (described below) mounted within frame 210 to the exterior so as to permit insertion of bottles from the turntable assembly into the station components.

Figure 10:
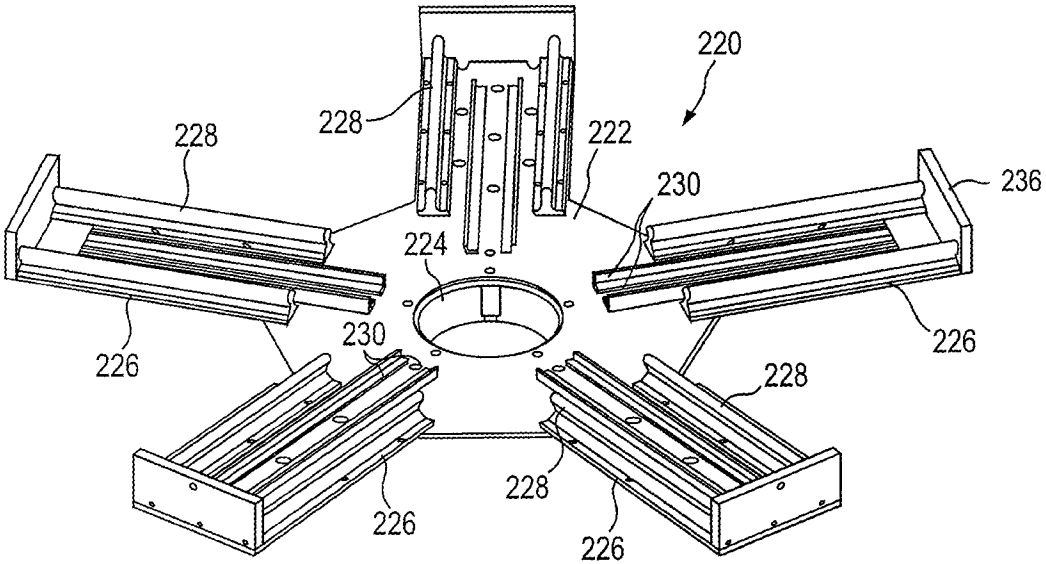
FIG. 10 is a perspective view of the turntable assembly of the second embodiment.
Figure 11:
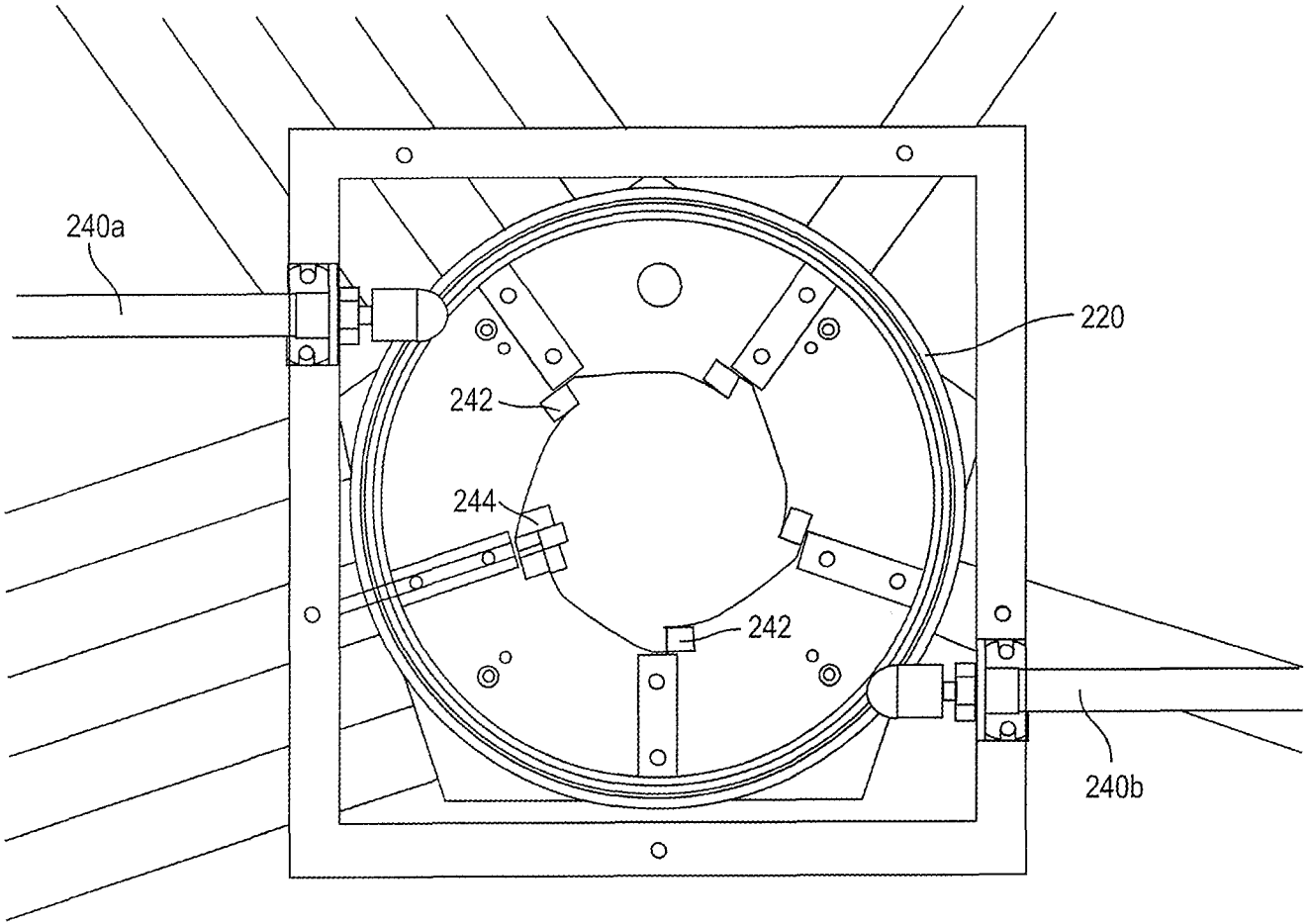
FIG. 11 is a plan view, from below, of the turntable assembly and related components for rotating the turntable of the second embodiment.

Lower frame 201 supports a rotating turntable assembly 220, which provides a rotating platform for bottle holders 260. As seen in FIGS. 10 and 11, assembly 220 comprises a central platform 222 which comprises a solid flat aluminum plate having a pentagon-shaped central platform, with five arms 226 extending radially outwardly from the vertices of the central platform. An aperture 224 is located in the center of platform 222, to receive a bottle holder assembly 260. Lateral supports 228 are provided on either side of arms 226 to provide additional rigidity.

Each arm 226 supports a pair of parallel rails 230 mounted on the upper surface thereof. Rails 230 comprise supports for supporting and engaging a bottle holder assembly, as discussed below. Rails 230 are ceramic coated aluminum, resulting in a precise, smooth and friction free slidable engagement with the bottle holders mounted thereon. The distal end of assembly 226 comprises a vertical wall 236, which forms a stop member for limiting the distal travel of bottle holder assemblies 260, as will be discussed below.

Figure 12:
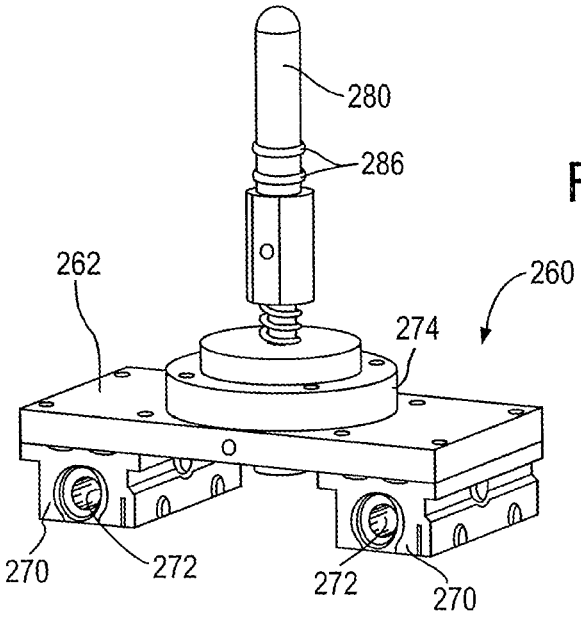
FIG. 12 is a perspective view of the bottle holder portion of the second embodiment.

Assembly 220 is rotatably mounted to lower frame 201 by a shaft rotatably journalled within a hub mounted to lower frame 201. A selectively actuated locking mechanism 244 (see FIG. 11), mounted to frame 201, prevents rotation of assembly 220 when engaged. Locking mechanism 244 is actuated by a pneumatic cylinder, not shown. Locking mechanism 244 can be actuated to engage one of a plurality of rubber bumpers 242 that extend downwardly from the lower face of turntable 220 to fix assembly 220 in a selected position. As seen in FIG. 11, assembly 220 is rotatably driven by a pair of opposing, offset pneumatic cylinders 240*a* and 240*b* which are positioned to sequentially contact rails 230 to incrementally advance the rotation thereof. After each incremental rotation, lock 244 is actuated to prevent further rotation, and released to permit further rotation by a respective one of cylinders 240*a* and *b*. Each of cylinders 240*a* and 240*b* are configured to rotate the turntable by 36 degrees with each cycle. Cylinders 240*a* and 240*b* sequentially contact rails 230 from opposing sides of turntable assembly 220, each advancing assembly 220 by 36 degrees, or one half of a step. Acting in sequence, cylinders 240*a* and *b* advance assembly 220 by a full step in order to rotate the assembly between stations, for alignment of each bottle carrier with a next-in-line station Turntable assembly 220 supports five bottle holders 260, each mounted on a respective arm 226. As seen in FIG. 12, bottle holder 260 comprises a base plate 262 which supports a freely rotatable and vertically moveable bottle-retaining post 280. A pair of slidable rail travellers 270 depend downwardly from the lower face of plate 262. Each traveler 270 comprises an elongate pillow block linear ball bearing having a channel 272 which engages a corresponding rail 230 for low friction sliding travel thereon, in a radial direction relative to platform 222. An extension spring is mounted to the end of each arm 226, and is configured to urge bottle holder 260 radially inwardly, in opposition to the outward force exerted by roller assembly 320, as described below.

Mounted to the upper surface of base plate 262 is a circular block 274, which houses a 25 millimeter graphite plugged, bronze sleeve bearing (not shown), which permits post 280 to both rotate and move vertically with minimal impedance. Post 280 is coupled to an electric motor, not shown but similar to the configuration described in the first embodiment, wherein post 280 can reciprocate vertically while rotating freely. The upper portion of post 280 is configured for insertion into the neck of bottle 1, and is fabricated from a hard and rigid plastic (such as Delrin™). One or more O-rings 286 encircle post 280 and are relatively soft and compressible to provide a snug friction fit on the bottle. Multiple, spaced apart O-rings 286 have been found to provide a snug fit with the bottle, and to secure the bottle against tipping or misalignment while being conveyed from station to station.

Figure 14:
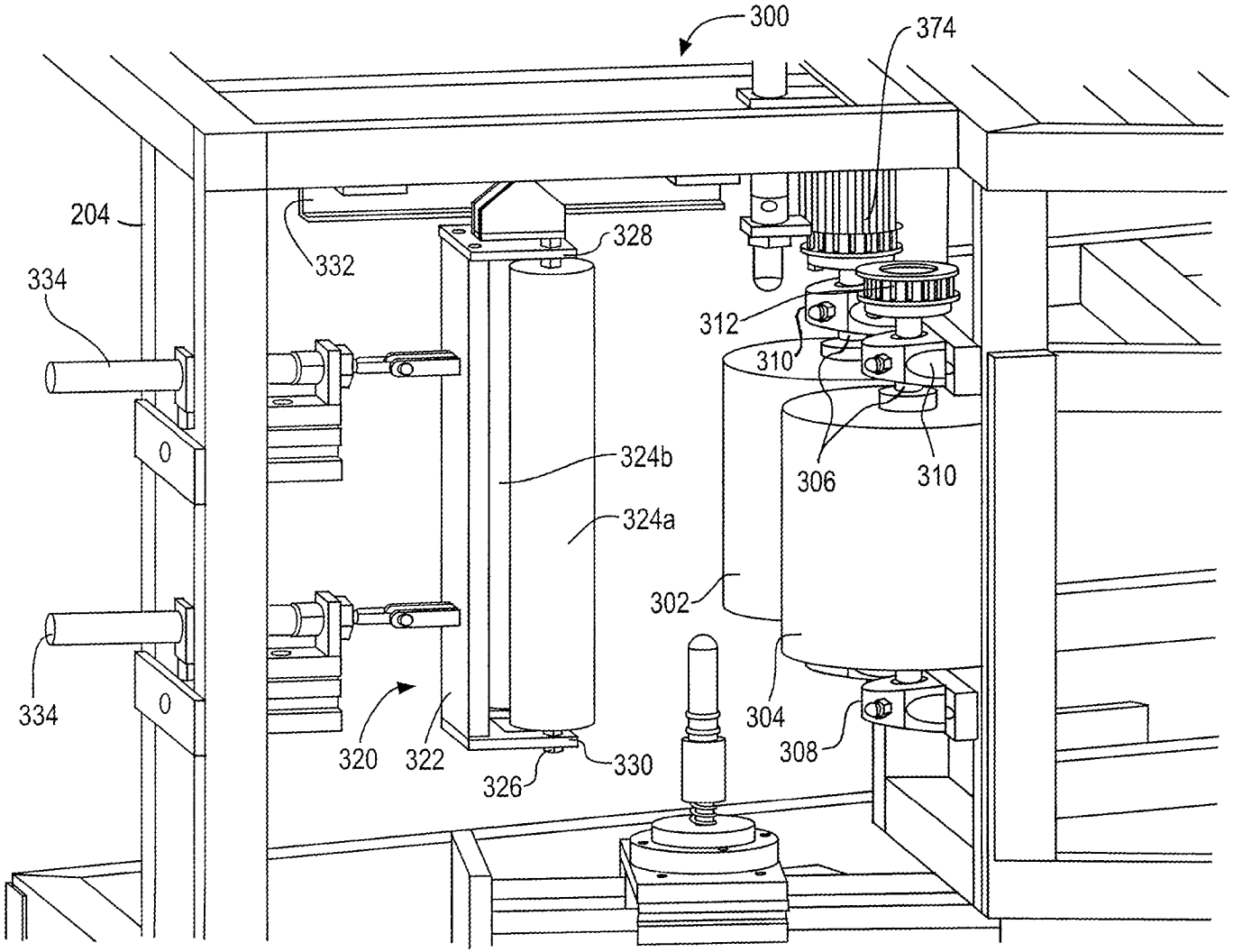
FIG. 14 is a perspective view of the mechanical brushing station of the second embodiment.

In operation, turntable assembly 220 rotates in incremental fashion between the respective stations, whereby following each incremental rotation, each of arms 226 aligns with a corresponding station for processing therein. The respective processing stations are retained within a central frame 240, with the bottle carrying assemblies rotating around the exterior thereof. The initial processing station comprises brushing station 300, as seen in FIG. 14. Brushing station 300 comprises two opposed rotating wire brushes 302 and 304, each comprising a vertical stack of individual stainless steep brush disks mounted on a shaft 306. Shafts 306 are rotatably journalled at their lower ends within lower bearing mounts 308, which in turn are mounted to frame 204. At their upper ends, shafts 306 are rotatably journalled within upper bearing mounts 310. Shafts 306 protrude through mount 310, with the protruding portions capped by cogs 312. Brushes 302 and 304 are rotatably driven by electric motor 374, which is linked to cogs 312 by timing belts, not shown.

Figure 13:
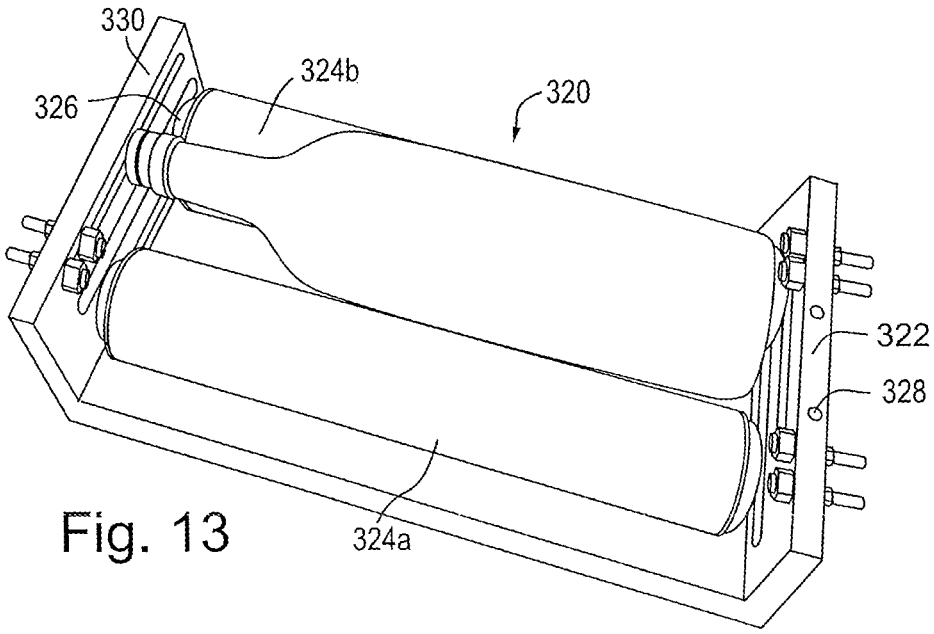
FIG. 13 is a perspective view of the roller assembly thereof.

A bottle mounted on a bottle holder 260 is urged against rotating brushes 302 and 304 by a slidable roller assembly 320, as seen in FIG. 13. Assembly 320 comprises a roller frame 322 which supports a pair of elongate rollers 324*a* and *b*, mounted for rotation about their vertical axes on shafts 326. Frame 322 includes upper and lower support plates 328 and 330, which include bearing mounts for rotatably journalling shafts 326. Frame 320 is suspended from an overhead track 332, mounted to overhead arms 208. Track 332 extends radially outwardly from frame 210 to permit alignment with a set of tracks 230 when positioned at the brushing station. Track 332 provides a sliding engagement with assembly 320, whereby assembly 320 may be moved towards or away from the rotating brush assembly. Horizontal movement of assembly 320 is driven by a pair of horizontally-disposed pneumatic cylinders 334, mounted on vertical support members of upper frame 202.

In operation, turntable assembly 220 is rotated and locked into a position whereby an arm 226 is aligned with the brushing station. The bottle holder associated with the corresponding arm 226, with a bottle vertically retained in an inverted position thereon, is then urged radially inwardly against the brush assembly by roller assembly 320. Roller assembly 320 also causes the bottle to rotate about its vertical axis. Rotation of the drive roller 324*a* rotates the bottle, on contact therewith, which in turn rotates driven roller 324*b*. Rotation of the bottle causes the full exterior surface of the bottle, or at least a substantial portion thereof, to be brought into rotating contact with rollers 302 and 304. Contact for a suitable dwell time causes the label to essentially fully removed, apart from a small amount of glue or glue residue not removed by the wire brushes.

Returning to FIG. 8, the next-in-line station comprises a solvent station 360. Solvent station 360 is similar to brushing station 300, including stainless steel brushes identical to those of the brushing station and a roller assembly 320. Solvent station 360 includes an overhead solvent-dispending nozzle for dispensing solvent (the nature of which is discussed below) onto the rotating bottle as this is contacted with the rotating wire brushes of the solvent station. Solvent is supplied to the nozzles from a solvent tank 370. The used solvent is trapped in a basin 372, located beneath the solvent station. The used solvent is pumped back into solvent tank 370, where it is pressurized and re-used. The next-in-line station comprises a rinse station 390, which is similar in structure to solvent station 360, but dispenses water in place of adhesive-removing solvent.

The next-in-line station comprises a bottle removal station, where the bottle may be removed by the operator.

Operation of the present system is controlled by central controller 400, which communicates with the motors, actuators and other drive members of the present system. Controller 400 comprises a PLC (Programmable logic controller), which is programmed with a readable code. PLC 400 receives inputs, and is coded to output commands to every electronic controlled component of the system. PLC 400 is programmed to provide a 40 second dwell period within each station, whereby the turntable is rotated by ⅕ of a revolution every 40 seconds to increment the loaded bottles to the next-in-line station, and the container supports are urged towards the respective stations for treatment. For safety, a button is provided for the operator which must be pressed before the PLC will proceed with the turning of the table. There is also a start/stop button which activates the system.

The PLC is governed by the inputs it receives from the "proceed" button, the "start/stop" button, and a series of reed switches. The reed switches are limit switches placed on the pneumatic cylinders, which inform the PLC whether or not the cylinders are extended or retracted. Therefore, if something was to go wrong with a pneumatic cylinder the PLC will temporary cease operation of the system.

A series of solenoids are controlled by the PLC, which control the flow of air into the pneumatic cylinders which drive the system. By switching the air flow on or off, each pneumatic cylinder can be extended or retracted at any given time. By controlling the exact movement of the pneumatic cylinders, turntable 220 can be rotated as described above, by extending cylinder 240*a*, which rotates the turntable ½ of a step (36 degrees), and then retracting cylinder 240*a* and extending cylinder 240*b*. The extension of cylinder 240*b* rotates the turntable the final ½ step (36 degrees) to advance the conveyors from one station to the next, at which point the lock-actuating cylinder extends to actuate locking mechanism 244, securing the turntable into place.

These solenoids also control pneumatic cylinders 324*a* and *b* which are part of roller assembly 320. Once the PLC has completed rotating the table and locking it into place, these pneumatic cylinders are extended, pushing the bottles forward to the wire brushes. The vertically mounted solenoids are also set by the PLC to push the bottle up and down as it is brushed. The activation of each pneumatic cylinder is precisely controlled by the PLC to run on a specified timing interval which is programmed into the PLC.

During this cycling of pneumatic cylinders the flow of solvent and water circulating is also controlled via the PLC. As each bottle 1 is urged towards a brush assembly in a respective station, the PLC activates a relay which actuates a hydraulic valve. The relay is used because the PLC outputs a signal of 24V and the hydraulic valves run on 110 V. The relay has a 110V input and is switched on by the signal from the PLC, opening the hydraulic valve and redirecting the flow of liquid. These hydraulic valves are used in conjunction with continuously running pumps, simply changing the direction of the flow back into the tank, avoiding constantly starting and stopping the pump. The relays are only used in controlling these hydraulic valves as the PLC output is 24V and both the solenoids and motorized roller controls are operated via a 24V input.

According to another aspect of the invention, the bottles are subject to an initial soaking step prior to loading onto assembly 10. According to this aspect, the bottles may be soaked or otherwise contacted with a solution in any convenient fashion, including immersion in a bath or subjected to a spray while in a rack, bin or other storage location. The solution is selected from any liquid that provides a preliminary softening of the label and/or partial dissolution of the label glue/adhesive to improve the initial brushing step. For example, the solution can comprise water or an aqueous glue-softening solution. Persons skilled in the art will be aware of a number of such solutions that are suitable for this purpose. The duration of the soaking step can range broadly, and is dictated in part by the processing volume and speed of processing required, the type of solution that is used and the duration and abrasiveness of the subsequent brushing steps. Optionally, the soaking step can further comprise an internal rinse with a sterilizing solution. Optionally, the initially soaking and/or internal rinse can comprise an additional station on the assembly located in advance of the initial brushing station.

The various embodiments presented herein are merely by way of an example of the invention and are in no way meant to limit the scope of this disclosure. Variations of the innovations described herein will become apparent from consideration of this disclosure and such variations are within the intended scope of the present disclosure. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combination will become readily apparent upon review of the present disclosure as a whole. The subject matter described herein and in the recited claims intends to cover and embrace all suitable changes in the technology.

What is claimed is:

1. A system for removing a glued-on label from an exterior surface of a container, said container having a base and an opening whereby a container axis extends between the base and the opening, said system comprising:

a brushing station for brushing the exterior surface of the container, said brushing station comprising at least one brush;

a solvent station for applying a liquid solvent for removal of adhesive from the container surface, said brushing and solvent stations being arranged in sequence;

at least one container support for retaining the container;

a first drive for displacing said container linearly when retained by said support to reciprocate said container between contact with said at least one brush and out of contact with said brush;

a second drive for rotating said at least one container about said container axis when in contact with said at least one brush whereby said label is scrubbed from said container by said brush; and a third drive for sequentially advancing said container between said stations.

2. The system of claim 1 further comprising a rinsing station next-in-line from the solvent station.

3. The system of claim 1 wherein the third drive advances said container support in indexed stepwise travel between said stations in discrete increments whereby said container is sequentially brought into alignment and contact with said brushing and solvent stations for sequential mechanical and solvent based label removing stages.

4. The system of claim 1 further comprising a rotating carousel comprising a plurality of said container supports, said stations being arranged in a circular path wherein rotation of said carousel by said third drive simultaneously advances all of said container supports to said stations.

5. The system of claim 1 further comprising a carousel comprising a plurality of said container supports, said stations being arranged in a circular path, wherein said third drive rotates said carousel to sequentially and simultaneously advance said container supports to said stations and said first drive comprises radial displacement of said container supports relative to said carousel to advance said container supports in a linear path towards said stations.

6. The system of claim 1 wherein said solvent station further comprises at least one brush, said system further comprising at least one fourth drive for imparting relative motion between said solvent station brush and a container when aligned therewith.

7. The system of claim 1 wherein said brushing station comprises a frame, a moveable assembly mounted to said frame for horizontal movement relative to the frame, and a rotatably driven brush mounted to said moveable assembly wherein said moveable assembly is configured to bring said brush into contact with said container when aligned with said station.

8. The system of claim 1 wherein said container support is configured for reciprocating vertical movement, and at least one of said stations further comprises a reciprocating drive member for imparting a vertical reciprocating movement to said container on said container support when aligned with said station.

9. The system of claim 1 further comprising an indexing system and a plurality of container supports, wherein said indexing system comprises a rotatably driven turntable with an array of radially-extending carriage supports thereon, said container supports each comprising a carriage engaged to a corresponding one of said carriage supports for travel along said corresponding carriage support wherein radial travel of said carriage along said corresponding carriage support brings said container into contact with a selected one of said stations when aligned therewith.

10. The system of claim 9 wherein at least one of said stations comprises a reciprocating contact assembly configured for urging said container radially along said corresponding carriage support for contact with said station.

11. The system of claim 9 further comprising at least one linear actuator configured to contact said turntable to rotate said turntable in discrete increments to sequentially advance said container supports in increments to sequentially align said supports with said stations.

12. The system of claim 11 further comprising a plurality of said linear actuators configured to operate in sequence whereby actuation of said linear actuators in sequence rotates said indexing system by said increments.

13. The system of claim 1 wherein said container support comprises a rotatable post configured for insertion into an open mouth of said container for rotation of said container.

14. The system of claim 9 further comprising a controller configured to control incremental advancement of said turntable in a step-wise fashion to sequentially align said container supports with said stations, and to control the advance and retraction said container supports at said stations for treatment at respective ones of said stations for a predetermined duration.

15. A system for removing a glued-on label from an exterior surface of a container, comprising:

a brushing station for dry-brushing the exterior surface of the container, said brushing station comprising at least one brush;

a solvent station for applying a liquid solvent for removal of adhesive from the container surface, said brushing and solvent stations being arranged in sequence;

at least one container support for retaining a container;

a first drive for imparting relative motion between said brush and one of said containers when aligned with said brushing station in a first direction of motion; and an indexing system for moving said container support for indexed stepwise travel between said stations in discrete increments whereby said container is sequentially brought into alignment and contact with said brushing and solvent stations for sequential mechanical and solvent-based label removing stages, wherein said indexing system comprises a first drive for advancing said containers between said stations in a first direction of motion and a second drive for advancing said containers between said stations in a second direction of motion.

16. The system of claim 15 wherein said indexing system comprises a carousel comprising a plurality of said container supports, said stations being arranged in a circular path, wherein said first drive of said indexing system rotates said carousel to sequentially and simultaneously advance said container supports to said stations and said second drive of said indexing system comprises radial displacement of said container supports relative to said carousel to advance said container supports towards said stations.

17. The system of claim 15 further comprising a rotatably driven turntable with an array of radially-extending carriage supports thereon, said container supports each comprising a carriage engaged to a corresponding one of said carriage support for travel along said carriage support wherein radial travel of said carriage along said carriage support brings said container into contact with a selected one of said stations when aligned therewith.

18. The system of claim 17 wherein at least one of said stations comprises a reciprocating contact assembly configured for urging said container radially along said carriage support for contact with said station and optionally at least one vertically aligned roller configured to contact said container to rotate said container when in contact with said roller.

19. The system of claim 17 further comprising at least one linear actuator configured to contact said turntable to rotate said turntable in discrete increments to sequentially advance said container supports in increments to sequentially align said supports with said stations.

20. The system of claim 19 comprising a plurality of said linear actuators configured to operate in sequence whereby actuation of said linear actuators in sequence rotates said indexing system by said increments.

21. The system of claim 15 wherein said first drive displaces said container linearly when retained by said support to reciprocate said container between contact with said at least one brush and out of contact with said brush.

22. The system of claim 15 further comprising a third drive for brushing the label from the container with the at least one brush.

23. A system for removing a glued-on label from an exterior surface of a container, said container having a base and an opening whereby a container axis extends between the base and the opening, said system comprising:

a support for retaining at least one container having a label adhered to an outside surface thereof;

at least one brushing station for brushing the exterior surface of the container for removing at least a portion of said label, said station comprising at least one brush;

a first drive for displacing said container linearly when retained by said support to reciprocate said container between contact with said at least one brush and out of contact; and a second drive for rotating said at least one container about said container axis when in contact with said at least one brush whereby said label is scrubbed from said container by said brush.

24. The system of claim 23 further comprising a frame having a hub and at least one rail extending radially from said hub, said first drive being configured to displace said container along said rail for reciprocal movement in said radial direction.

25. The system of claim 23 further comprising a third drive associated with said support for imparting reciprocal movement to said container along said container axis.

26. The system of claim 25 wherein said support retains said container whereby said container axis is vertical and said third drive is configured to displace said bottle vertically.

* * * * *